US010801806B2

(12) United States Patent
Fricke et al.

(10) Patent No.: US 10,801,806 B2
(45) **Date of Patent: *Oct. 13, 2020**

(54) MUZZLELOADER BARREL AND SYSTEM

(71) Applicant: Lehigh Defense, LLC, Quakertown, PA (US)

(72) Inventors: David Fricke, Trumbauersville, PA (US); Gregory M. Schmell, Souderton, PA (US)

(73) Assignee: Lehigh Defense, LLC, Quakertown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/249,509

(22) Filed: Jan. 16, 2019

(65) Prior Publication Data

US 2020/0224997 A1 Jul. 16, 2020

(51) Int. Cl.
*F41C 9/08* (2006.01)
*F41A 21/00* (2006.01)
*F41C 27/00* (2006.01)

(52) U.S. Cl.
CPC ..... *F41C 9/08* (2013.01); *F41A 21/00* (2013.01); *F41C 9/085* (2013.01); *F41C 27/00* (2013.01)

(58) Field of Classification Search
CPC ..... F41C 9/08; F41A 21/00
USPC ..... 42/51
See application file for complete search history.

(56) References Cited

U.S. PATENT DOCUMENTS 173,476 A * 2/1876 Ladd ..... F42B 8/10 42/76.01
4,128,040 A * 12/1978 Schuetz ..... F41A 21/26 89/14.5
4,232,468 A 11/1980 Chapin
4,242,825 A * 1/1981 deBoer ..... F41A 9/58 42/106
4,918,849 A * 4/1990 Spota ..... F41C 9/08 42/51
4,969,283 A * 11/1990 Baehr ..... F41A 21/00 42/70.01
5,206,445 A * 4/1993 Comley ..... F41A 19/07 42/105
5,408,776 A * 4/1995 Mahn ..... F41C 9/08 42/51
5,623,779 A 4/1997 Rainey, III
6,176,030 B1 * 1/2001 Ball ..... F41C 9/08 42/51
6,385,887 B1 5/2002 Johnston
7,877,919 B2 2/2011 Richards
9,546,844 B2 1/2017 Hall et al.
10,288,374 B1 * 5/2019 Fricke ..... F41A 21/30
2002/0129531 A1 9/2002 Camp
2005/0183318 A1 * 8/2005 McGivern ..... F41A 21/00 42/76.01

(Continued)

OTHER PUBLICATIONS

Owner's Manual, Instruction Book for: Model 700™ Ultimate Muzzleloader, Remington®, 2014 Remington Arms Company, LLC.
Silencerco Maxim® 50, Instruction Manual, 2017 Silencer Co. LLC.

*Primary Examiner* — Bret Hayes
(74) *Attorney, Agent, or Firm* — Fox Rothschild LLP

(57) ABSTRACT

The disclosure relates to a muzzleloader barrel having at least one seat pin, and a muzzleloader system that includes a muzzleloader barrel having at least one seat pin and an ignition device, wherein the muzzleloader barrel and muzzleloader system are configured to operate without a breech plug.

22 Claims, 5 Drawing Sheets

(56) References Cited

U.S. PATENT DOCUMENTS

| | | | | |
|---|---|---|---|---|
| 2006/0086029 | A1 | 4/2006 | Kirkpatrick | |
| 2007/0028499 | A1* | 2/2007 | DeLeeuw | F41A 3/58 42/51 |
| 2008/0282596 | A1 | 11/2008 | DeLeeuw | |
| 2011/0296729 | A1 | 12/2011 | Overstreet | |
| 2014/0298702 | A1 | 10/2014 | Johnston | |
| 2014/0360070 | A1* | 12/2014 | Hendricks | F41B 11/60 42/1.08 |
| 2015/0013202 | A1 | 1/2015 | Hendricks et al. | |
| 2015/0101231 | A1* | 4/2015 | Giannini | F41A 21/00 42/76.01 |
| 2016/0091275 | A1* | 3/2016 | Leykin | F41C 9/08 42/51 |
| 2016/0313082 | A1 | 10/2016 | Shults et al. | |
| 2017/0307347 | A1 | 10/2017 | Peterson et al. | |
| 2019/0003801 | A1 | 1/2019 | Ibarguren et al. | |

* cited by examiner

SECTION A-A

MUZZLELOADER BARREL AND SYSTEM

BACKGROUND

A muzzleloader is an antique firearm in which a powder charge and projectile are loaded into the muzzle end of the barrel. Unlike modern breech loaded firearms where the projectile, propellant charge and primer are loaded as pre-packaged cartridges, muzzleloaders are typically loaded by ramming a bullet down the barrel with a ramrod until the bullet is seated against a previously loaded propellant charge. A primer may then be loaded at the breech end, in proximity with the propellant. When the primer is struck by an inline firing pin or external hammer, the propellant charge ignites, creating propellant gases that propel the projectile out of the barrel.

In many muzzleloaders, the closed breech end of the barrel is replaced with a screw-in, removable breech plug, which generally facilitates cleaning. However, over time, rapid temperature changes during firing as well as the corrosive nature of many propellants can cause the threads of the breech plug and barrel to seize, making it difficult to remove the breech plug. The breech plug also positions the primer ignition force away from the powder charge, complicating the combustion process.

Accordingly, there is a strong need for an improved design.

SUMMARY

The present disclosure relates generally to a muzzleloader barrel and muzzleloader system, including a muzzleloader configured to operate without a breech plug.

In one aspect, the disclosed technology relates to a muzzleloader barrel, including: a forward end, a rearward end, and a central bore, the central bore having a central axis, wherein the rearward end includes a breech that is configured to receive an ignition device; and at least one seat pin that protrudes into a portion of the central bore of the barrel, the at least one seat pin being secured to an interior portion of the barrel. In one embodiment, the at least one seat pin is arranged tangentially to the central bore. In another embodiment, the at least one seat pin is formed from a material including tungsten carbide. In another embodiment, the at least one seat pin is press-fit into the interior of the barrel. In another embodiment, the interior portion of the barrel includes two seat pins. In another embodiment, the two seat pins are substantially parallel to each other. In another embodiment, the at least one seat pin protrudes across about 60% to about 90% of the diameter of the central bore. In another embodiment, the muzzleloader barrel of claim 1. In another embodiment, the muzzleloader does not include a breech plug. In another embodiment, the muzzleloader is configured such that fixed ammunition cannot be loaded into the breech.

In another embodiment, the muzzleloader further includes an ignition device. In another embodiment, the ignition device includes a propellant powder and a primer. In another embodiment, the propellant powder is black powder or black powder substitute. In another embodiment, the ignition device has a length of about 0.5 to about 3 inches. In another embodiment, the breech is configured such that the ignition device cannot contain a projectile. In another embodiment, an end portion of the ignition device is distorted and configured to open when a propellant powder within the ignition device is ignited. In another embodiment, the ignition device is configured to be destroyed upon firing. In another embodiment, the ignition device includes a visible indicator that corresponds to at least one of a generated energy level of the ignition device, a weight of a projectile, and an obtained velocity when firing the projectile. In another embodiment, the muzzleloader further includes an extractor configured to eject the ignition device from the breech after firing.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1:
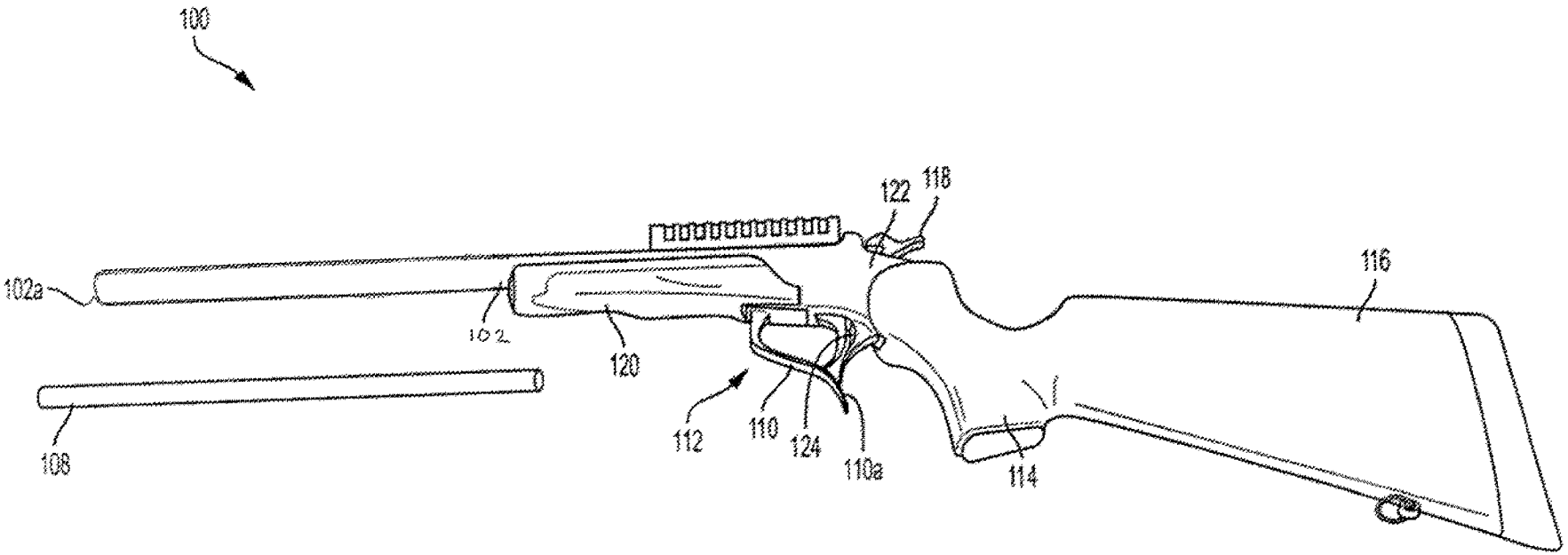
FIG. 1 illustrates a side view of an example muzzleloader that does not have a breech plug according to the present disclosure.

The following discussion omits or only briefly describes conventional features of muzzleloader systems, such as trigger and firing mechanisms, which are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "comprises" and/or "comprising," when used in this specification, specify the presence of stated features, elements, and/or components, but do not preclude the presence or addition of one or more other features, steps, operations, elements, components, and/or groups thereof.

Embodiments of the present disclosure relate generally to a muzzleloader system, and more particularly, to a muzzleloader configured to operate without a breech plug. Embodiments of the disclosed muzzleloader are described below with reference to FIGS. 1-8.

Figure 2:
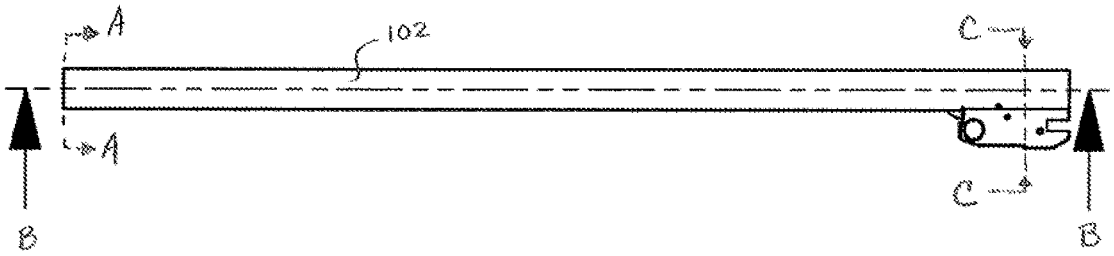
FIG. 2 illustrates a side view of a muzzleloader barrel of an example muzzleloader of the present disclosure.
Figure 3:
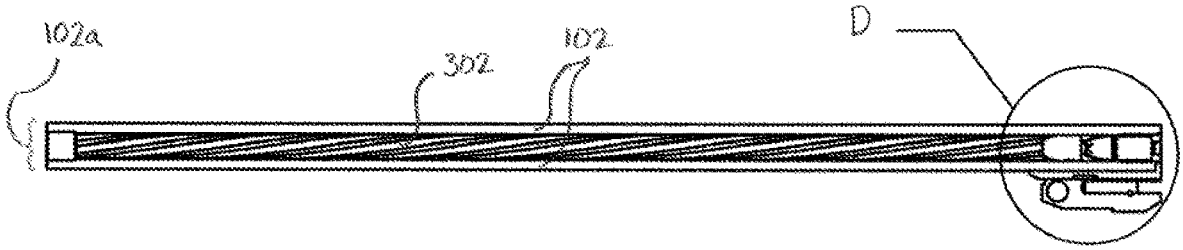
FIG. 3 illustrates a cross-sectional side view taken along section A-A of the muzzleloader barrel depicted in FIG. 2.

FIG. 1 illustrates a side view of an example muzzleloader 100. FIG. 2 illustrates a side view of a muzzleloader barrel 102 of the muzzleloader 100 depicted in FIG. 1. FIG. 3 is a cross-sectional side view taken along section A-A of the muzzleloader barrel 102 depicted in FIG. 2.

The muzzleloader 100 includes at least one of a muzzleloader barrel 102, fire control group 112, grip 114, a stock 116, a hammer 118, a handguard 120, and a receiver 122.

In some embodiments, the muzzleloader 100 may be an in-line style muzzleloader, a break-open style muzzleloader, or a bolt-action style muzzleloader. The below description describes a break-open style muzzleloader, but it should be noted that one or more embodiments described herein are equally applicable to a bolt-action or other style muzzleloader.

The receiver 122 is configured to house a firing mechanism and associated components as found in, for example, muzzleloaders. The firing mechanism may include the fire control group 112, which may include a trigger 124 configured to be pulled by a user (e.g., by the user's index finger) to initiate the firing cycle sequence of the muzzleloader 100. The trigger 124 can have a variety of different shapes. For example, the trigger 124 can have a generally curved profile. In other examples, the trigger 124 can have a generally straight profile. The fire control group 112 may also include a trigger guard 110 formed around the trigger 124, wherein each end of the trigger guard 110 is connected to and installed in the receiver 122. The trigger guard 110 may protect the trigger 124 from accidental discharge. The fire control group 112 may also include a trigger guard spur 110*a* configured to be pulled by the user in order to open the breech of the muzzleloader 100. The trigger guard spur 110*a* may be a portion of the trigger guard 110 that extends outward from a lower portion of the trigger guard 110. Additionally, the trigger guard spur 110*a* may have a variety of different shapes including, but not limited to, a generally curved profile or a generally straight profile. In some examples, the trigger guard spur 110*a* has a profile extending downward in a similar downward direction as the grip 114.

The fire control group 112 is mounted to the receiver 122 and is configured to discharge the muzzleloader 100 when a predetermined amount of force is applied to the trigger 124. The fire control group 112 may also be configured to open the breech of the muzzleloader 100 when a predetermined amount of force is applied to the trigger guard 110 or trigger guard spur 110*a*.

The stock 116 is configured to be positioned at a rearward portion of the muzzleloader 100 and provides an additional surface for the user to support the muzzleloader 100, typically against the user's shoulder. In some embodiments, the stock 116 is integrated with the grip 114. In some embodiments, the stock 116 is a thumbhole stock. In other embodiments, the stock 116 includes a mount for a sling. In yet other embodiments, the stock 116 is a telescoping stock. In still other embodiments, the stock 116 is foldable. In some embodiments, the stock 116 is removably mounted to either the receiver 122 or the grip 114. In at least one embodiment, the stock 116 is threaded to the receiver 122. In other embodiments, the stock 116 is secured to the receiver 122 or the grip 114 by a fastener, such as a takedown screw.

The muzzleloader barrel 102 is positioned at a forward end of the muzzleloader 100 and also extends over a middle portion of the muzzleloader 100. In some embodiments, the muzzleloader barrel 102 is attached to the handguard 120 by one or more fasteners. In one or more embodiments, the muzzleloader barrel 102 may be attached to the receiver 122, for example, via a receiver lug 426 that is positioned within at least a portion of the receiver 122. In some examples, the muzzle end 102*a* of the muzzleloader barrel 102 may have a cylindrical opening that is large enough to allow both a projectile and a drop tube 108 to pass there-through. In other examples, the muzzle end 102*a* may be tapered toward the rear end of the muzzleloader 100. The tapered shape of the muzzle end 102*a* may allow a drop tube 108 to be more easily inserted into the muzzleloader barrel 102.

Figure 4:
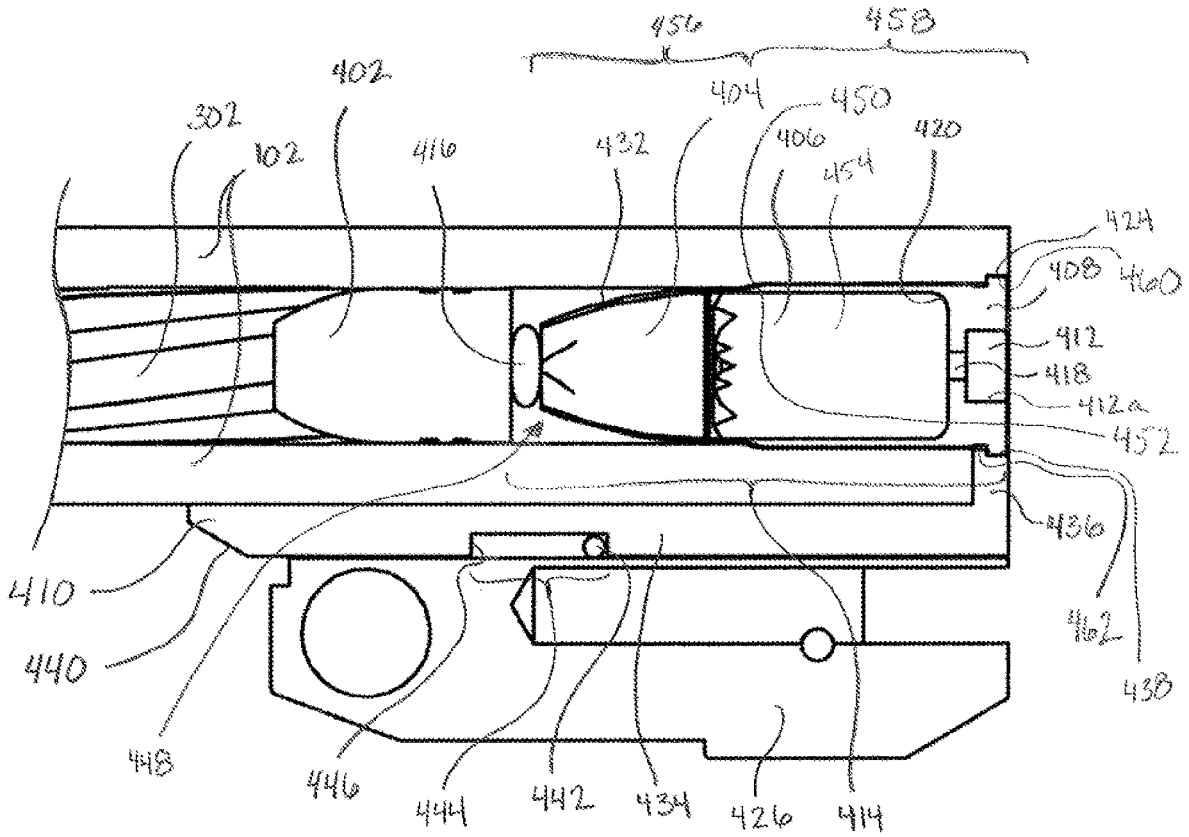
FIG. 4 illustrates an ignition system of an example muzzleloader, and provides an enlarged view of detail D encircled in the cross-sectional side view of the muzzleloader barrel depicted in FIG. 3.

The muzzleloader barrel 102 provides a path to release an explosion, such as one caused by the hammer 118 striking a primer of an ignition device, for example the ignition device 408 illustrated in FIG. 4, and igniting the ignition device. The muzzleloader barrel 102 also provides a path for a projectile, for example the projectile 402 illustrated in FIG. 4, to be propelled through the muzzleloader barrel 102. The dimensions of the muzzleloader barrel 102 and ignition device are configured such that the ignition device cannot contain a projectile when loaded into a breech end of the muzzleloader barrel 102.

The muzzleloader barrel 102 may be configured in a variety of sizes corresponding to a desired twist rate of a projectile. For example, the muzzleloader barrel 102 may be configured to be a fast twist barrel. For instance, the length of the muzzleloader barrel 102 may be about 16 inches. In some examples, the muzzleloader 100 can be a high velocity muzzleloader. In yet other examples, the muzzleloader barrel 102 is configured to be a slow twist barrel, in which case the twist rate of the muzzleloader barrel 102 may be about 1:8 to 1:72. In some embodiments, the muzzleloader barrel 102 is rifled. In other embodiments, the muzzleloader barrel 102 has a smoothbore. In some embodiments, the muzzleloader barrel 102 includes a rail system for mounting accessories (e.g., foregrip, flashlight, laser, optic equipment, etc.) thereto. In some embodiments, the muzzleloader barrel 102 may be configured to fire a full bore projectile or an under bore projectile housed in a sabot.

In some embodiments, the overall length of the muzzleloader 100, from the stock 116 to the muzzle end 102*a* of the muzzleloader barrel 102, is about 27 inches to about 40 inches, such as about 31 inches to about 36 inches. In one embodiment, the weight of the muzzleloader 100 (loaded or unloaded) is about 4 pounds to about 8 pounds, such as about 4.5 pounds to about 6 pounds.

The grip 114 provides a point of support for the user of the muzzleloader 100 and can be held by the user's hand, including when operating the fire control group 112. The grip 114 assists the user in stabilizing the muzzleloader 100 during firing and manipulation of the muzzleloader 100. In some embodiments, the grip 114 is mounted to the receiver 122.

To prepare the muzzleloader 100 for firing, a user may insert the drop tube 108 into the muzzle end 102*a* such that an end of the drop tube 108 reaches a portion of the barrel bore 302. As shown in FIG. 3, the barrel bore 302 is the central bore of the muzzleloader barrel 102, in which the central bore has a central axis. A user may then insert a projectile, such as projectile 402, into the drop tube 108. In one example, the projectile 402 may travel down the drop tube 108 and settle in the barrel bore 302. A ramrod (not shown) may then be used to push the projectile 402 further through the barrel bore 302 until the projectile 402 is seated on the outer surface of at least one seat pin 416. In the non-limiting embodiment depicted in at least FIGS. 4, 6, and 8 and discussed herein, two seat pins 416 are shown. In other suitable embodiments, the muzzleloader may have 1, 2, 3, 4, 5, or more pins. Also, as used herein, the term "pin" or "pins" (e.g., seat pin 416) on which the projectile is seated is a general term that refers to a round pin, screw, square pin, flat pin, solid cylindrical pin, tapered pin, groove pin, spring pin, or any other shaped component or structure that would serve the same purpose described herein. The ramrod and drop tube 108 are removed from the muzzleloader 100 prior to firing. While the muzzleloader 100 is in a break open position, an ignition device, such as ignition device 408, may be inserted into a breech opening, such as breech 414, in a breech end of the muzzleloader barrel 102. The muzzleloader 100 is then returned to the closed position, and is ready to be fired.

The muzzleloader 100 is configured to fire a projectile, such as projectile 402 illustrated in FIG. 4. Examples of suitable projectiles include, but are not limited to, lead shot, bird shot, a lead round ball, a lead Minié ball, a saboted bullet, a lead-jacketed or copper jacketed bullet having any of a spire point, round nose, hollow point, or flat nose, and a monolithic bullet having any of a spire point, round nose, hollow point, or flat nose.

Other embodiments of the muzzleloader 100 may have configurations other than the examples illustrated and described with reference to FIG. 1. For example, one or more of the components listed above are not included in some alternative embodiments.

Figure 5A:
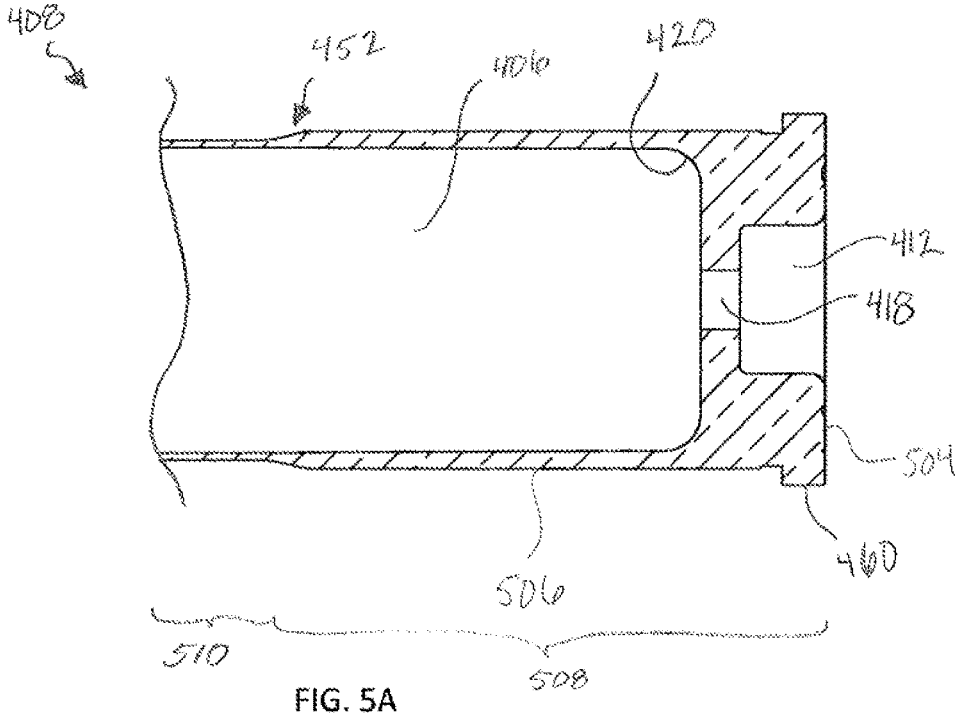
FIG. 5A illustrates a cross-sectional view of the ignition system depicted in FIG. 4.
Figure 5B:
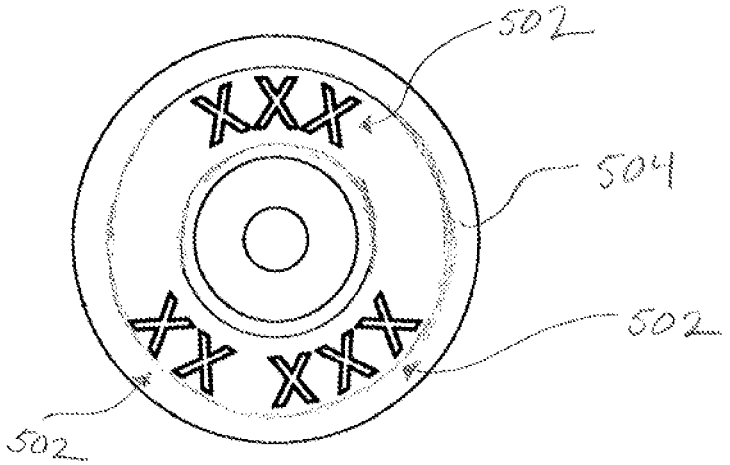
FIG. 5B illustrates a rear view of the ignition system depicted in FIG. 4.
Figure 6:
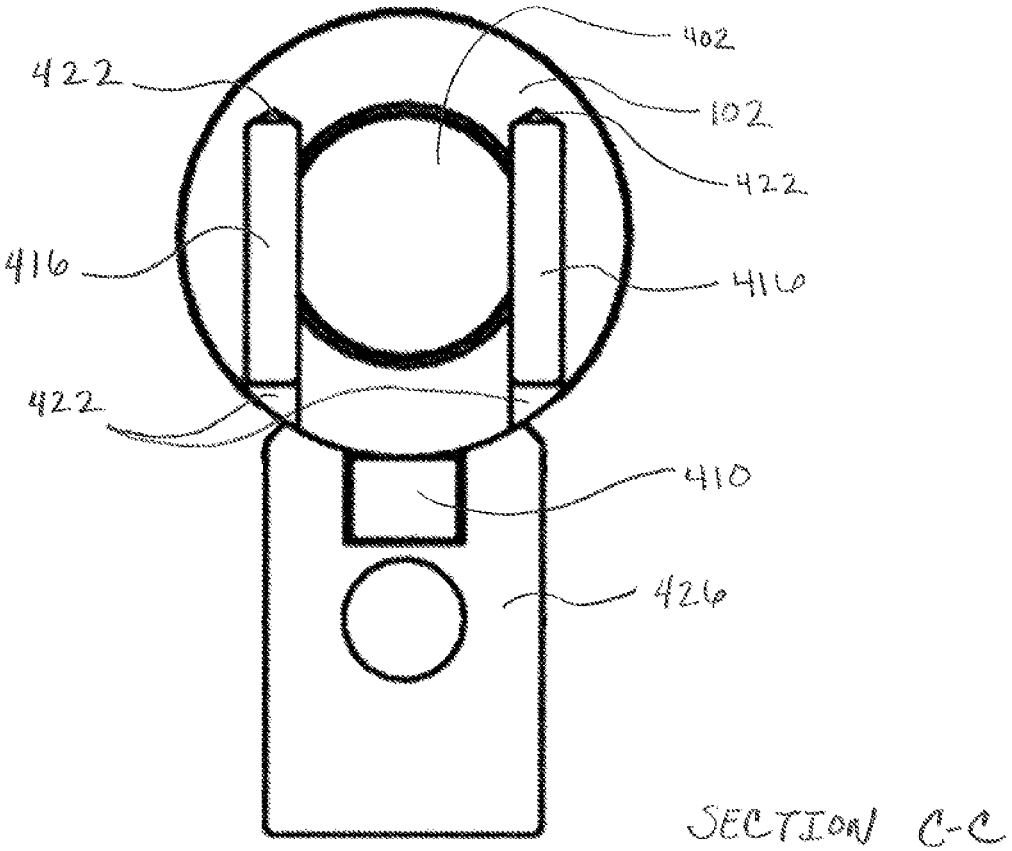
FIG. 6 illustrates a cross-sectional view taken along section C-C of the muzzleloader barrel depicted in FIG. 2.
Figure 7:
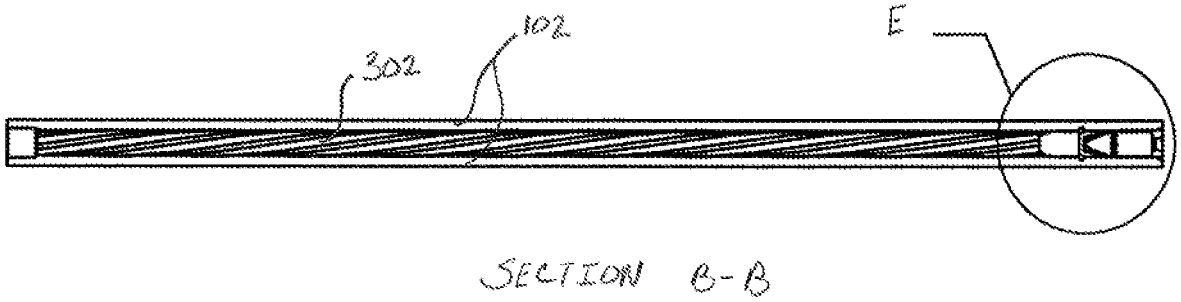
FIG. 7 illustrates a cross-sectional top view taken along section B-B of the muzzleloader barrel depicted in FIG. 2.
Figure 8:
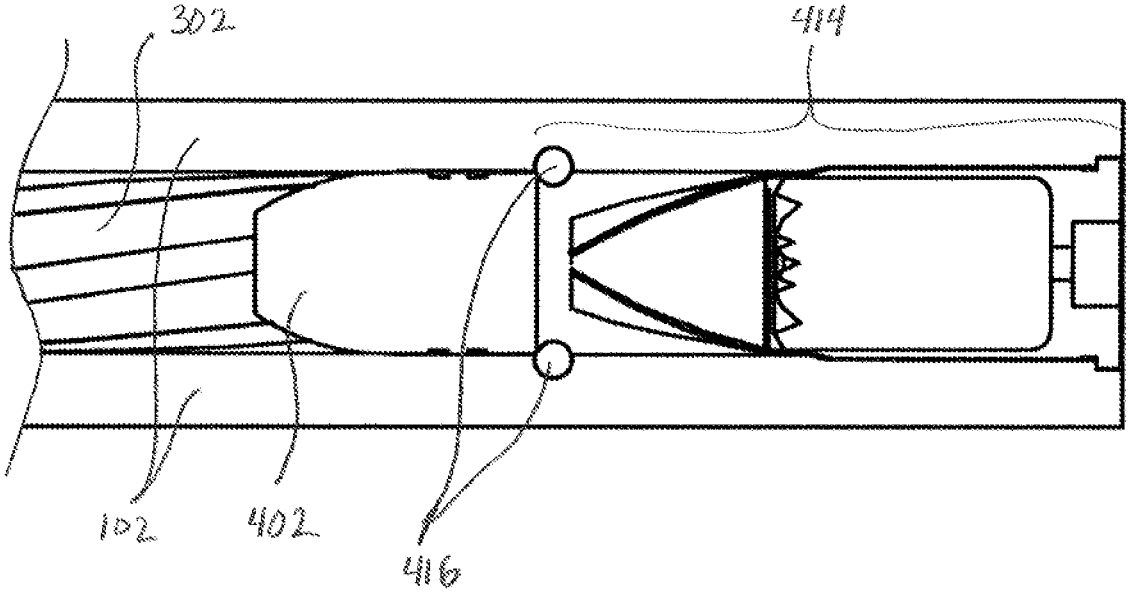
FIG. 8 illustrates an ignition system of an example muzzleloader, and provides an enlarged view of detail E encircled in the cross-sectional top view of the muzzleloader barrel depicted in FIG. 7.

FIG. 4 is an ignition system of an example muzzleloader, and provides an enlarged view of detail D encircled in the cross-sectional side view of the muzzleloader barrel 102 depicted in FIG. 3. FIG. 5A illustrates a cross-sectional view of the ignition system depicted in FIG. 4. FIG. 5B illustrates a rear view of the ignition system depicted in FIG. 4. FIG. 6 is a cross-sectional view taken along section C-C of the muzzleloader barrel 102 depicted in FIG. 2. FIG. 7 illustrates a cross-sectional top view taken along section B-B of the muzzleloader barrel 102 depicted in FIG. 2. FIG. 8 illustrates an ignition system of an example muzzleloader, and provides an enlarged view of detail E encircled in the cross-sectional top view of the muzzleloader barrel 102 depicted in FIG. 7.

In one or more embodiments, the muzzleloader 100 is configured to operate without a breech plug. In one or more embodiments, a breech 414 of the muzzleloader barrel 102 is configured to receive an ignition device 408 that provides the ignition source to fire the projectile 402. The outer rim 460 of the ignition device 408 may be configured to fit within a recessed groove 424 on an outer end of the breech 414. The ignition device 408 may include at least one of a cartridge cap 404, powder 406, and primer 412. When the breech 414 is opened, such as when a user presses on the trigger guard spur 110*a* thereby breaking open the muzzleloader 100 and exposing the breech 414, the ignition device 408 may be inserted into the breech 414.

In one or more embodiments, an end portion 432 of the cartridge cap 404 may be crimped or otherwise distorted such that a distal end of the end portion is narrower than the proximal end of the end portion 423. The crimped end portion 432 may form a conical shape. The end portion 432 may be crimped such that the end portion 432 is sealed and prevents powder 406 from exiting the end portion 432 when the primer 412 of the ignition device 408 is not ignited. In some embodiments, the crimped end of the end portion 432 is configured to open when the powder 406 is ignited via the primer 412.

In some examples, the ignition device 408 may have a minimum length of about 0.5 inches and a maximum length of about 3 inches. In some examples, the ignition device 408 is long enough such that the outer rim 460 prevents the end portion 432 of the ignition device 408 from contacting the projectile 402. In some examples, the ignition device 408 is long enough such that there is a space between the outermost portion of the end portion 432 and the ends of the seat pins 416 closer to the end portion 432. Upon ignition of the ignition device 408, the end portion 432 opens such that the sides of the end portion 432 are parallel or substantially parallel with the inner walls of the breech 414. When the sides of the end portion 432 are opened, the linear length of the ignition device 408 increases. For example, the linear length of the ignition device 408 increases about 0.010 inches to about 0.025 inches, such as about 0.015 inches. The space between the outermost portion of the end portion 432 and the ends of the seat pins 416 allows the sides of the end portion 432 to open without contacting or "wrapping" over the seat pins 416 after ignition, thereby allowing the ignition device 408 to be easily removed from the chamber 448. In other examples, the ignition device 408 is long enough such that the outer rim 424 prevents the end portion 432 from extending beyond the seat pins 416 on the ends closer to the projectile 402.

In one or more embodiments, a chamber 448 is included in (e.g., machined into) the breech 414. In one or more embodiments, the chamber 448 is configured to house the ignition device 408. In general, the chamber 448 extends from the face of the breech 414 (i.e., the end surface of the muzzleloader barrel 102) to the seat pin(s) 416. The chamber 448 may terminate at the side of the seat pin(s) 416 nearest the breech face. In one or more embodiments, the chamber 448 is configured such that no standard fixed ammunition (i.e., ammunition that includes a case, primer, powder charge, and a bullet) can be loaded into the breech 414 and fired by the muzzleloader 100. In one or more embodiments, the length and/or diameter of the chamber 448 are configured to only receive the ignition device 408 and to prevent other ignition devices from being inserted into the breech 414. In one or more embodiments, the ignition device 408 has a geometry that cannot be achieved with any fixed ammunition case, and is configured to fit within the chamber 448.

As shown in FIG. 4, the chamber 448 may include a first portion 456 and a second portion 458, wherein the diameter of the second portion 458 is greater than the diameter of the first portion 456. The first portion 456 and the second portion 458 may interface with one another so as to form a groove 450 that extends circumferentially around the inner surface of the chamber 448. The groove 450 may taper toward the rear of the muzzleloader barrel 102. In some embodiments, the groove 450 may be formed at a right angle. As shown in FIG. 5A, the ignition device 408 may also include a third portion 508 and a fourth portion 510, wherein the diameter of the third portion 508 is greater than the diameter of the fourth portion 510. The third portion 508 and the fourth portion 510 may interface with one another so as to form a rim 452 or bottleneck-type structure that extends circumferentially around the outer surface of the ignition device 408. The third portion 508 may be configured to fit within the first portion 456. The fourth portion 510 may be configured to fit within the second portion 458.

In one or more other examples, the outer rim 460 of the ignition device 408 and the recessed groove 424 may each be configured in a shape such that the outer rim 460 and recessed groove 424 interlock with one another, thereby preventing a cartridge with a round case head from being loaded into the chamber 448. For instance, the outer rim 460 may include at least one linear surface forming a semi-"D" shape, and the recessed groove 424 may include a corresponding shape to receive the "D" shaped outer rim 460, thereby preventing a cartridge with a round case head from being loaded into the chamber 448.

In some embodiments, the powder 406 is positioned within a powder pocket 454 of the ignition device 408. The powder pocket 454 may be configured to hold the powder 406. The powder pocket 454 may include a charge cavity base 420 that increases the integrity of the ignition device 408 when an explosion is generated within the ignition device 408. The powder 406 is black powder or black powder substitute. In some examples, the black powder substitute may be in the form of a solid, such as a pellet, or may be in a loose powder form. As shown in FIG. 4, the primer 412 may be positioned within a primer pocket 412*a* of the ignition device 408. In general, the primer 412 is positioned within the ignition device 408 so as to receive a strike from the hammer 118 of the muzzleloader 100. When the primer 412 is struck by the hammer 118, the struck primer 412 generates a spark and/or flame that travels through a flash hole 418 in the ignition device 408 and ignites the powder 406, thereby causing an explosion between the cartridge cap 404 and the powder 406. The flash hole 418 may provide a pathway for the spark or flame to travel from the primer pocket 412*a* to the powder 406. Further, the energy generated by the explosion may travel through the breech 414 and propel the projectile 402 through the muzzleloader barrel 102 out of the muzzleloader 100. In one or more embodiments, the ignition device 408 is configured to ignite only once, as the casing of the ignition device 408 is destroyed during firing. For example, as the explosion generated within the ignition device 408 travels out of the end portion 432, the crimped end portion 432 opens such that the crimped end portion 432 is not reusable. Consequently, after firing, the crimped end portion 432 cannot be closed so that powder 406 will remain sealed in the powder chamber 454. In one or more embodiments, the ignition device 408 cannot be disassembled and/or modified without being destroyed.

In some embodiments, the breech 414 is large enough to receive the ignition device 408. For example, the breech 414 may have a diameter that is larger than the diameter of the barrel bore 302. In some embodiments, one or more bore holes 422 may be formed into the muzzleloader barrel 102. The one or more bore holes 422 may be blind holes such that the bore hole 422 is drilled on a portion of the outer diameter of the muzzleloader barrel 102, and extends into the muzzleloader barrel 102 without breaking through the opposite side of the muzzleloader barrel 102. In some embodiments, the one or more bore holes 422 are each formed perpendicularly into the muzzleloader barrel 102 for each seat pin 416, when viewed from a cross-sectional view taken along section A-A of the muzzleloader barrel 102. The bore holes 422 may be formed substantially parallel to one another. One or more bore holes 422 may be formed at the inner end of the breech 414. In some embodiments, one or more bore holes 422 may be formed at the end of the rifled portion of the muzzleloader barrel 102. In other embodiments, one or more bore holes 422 may be formed at the end of the rifled portion of the muzzleloader barrel 102 and at a front portion of the breech 414.

In some embodiments, the one or more bore holes 422 (and thus the one or more seat pins 416) may be formed in a variety of manners, including, but not limited to, radially, tangentially, or in a radial pattern, extending through or partially into the barrel bore 302. Non-limiting examples of suitable configurations of bore hole(s) and pin(s) include one tangential pin, two tangential pins, one pin fully through the barrel bore 302, two pins each fully through the bore, one pin protruding just into the barrel bore 302 substantially perpendicular to the bore, two pins each protruding just into the barrel bore 302 substantially perpendicular to the barrel bore 302, and combinations and variations thereof. In one or more embodiments, the outer diameter of the bore hole 422 is configured into a shape for receiving the seat pin 416. For example, if seat pin 416 has a cylindrical shape, the bore hole 422 may have a cylindrical shape with a diameter large enough to receive a cylindrical seat pin 416. In another example, if seat pin 416 is a screw, the outer walls of the bore hole 422 may be threaded to receive a screw shaped seat pin 416.

In some embodiments, a seat pin 416 is inserted and fastened into each bore hole 422 such that the seat pin 416 cannot be removed from the muzzleloader barrel 102. For example, a seat pin 416 may be inserted into bore hole 422 and fastened in place by welding, press fitting, brazing, using an epoxy, or other fastening means. The seat pin 416 may be long enough such that a space remains on an outer end of the bore hole 422 to fasten (e.g., via welding) the seat pin 416 into the bore hole 422. Excess material, such as weld metal or filler materials, that extends beyond the outer diameter of the muzzleloader barrel 102 may be ground or sanded down to the outer diameter of the muzzleloader barrel 102. As shown in FIG. 6, a portion of each seat pin 416 may extend into the space defined by the barrel bore 302, when viewed from a cross-sectional view taken along section C-C of the muzzleloader barrel 100. In one or more embodiments, a seat pin 416 is configured to function as a positive stop for a projectile, which is loaded from the muzzle end 102*a* and rests on the one or more seat pins 416. In some embodiments, the seat pin(s) 416 is protrudes into the barrel bore 302 far enough to allow a projectile to be loaded from the muzzle end 102*a* and be seated on the seat pin(s) 416. In some embodiments, the seat pin(s) 416 protrudes into the barrel bore 302 far enough to prevent a projectile from being pressed further down the barrel bore 302 and into the breech 414. Further, in some embodiments, the seat pin(s) 416 protrudes into the barrel bore 302 far enough to prevent a projectile from being loaded into the barrel bore 302, via inserting the projectile into the breech 414. In one or more embodiments, the seat pin(s) 416 are configured to preclude any centerfire cartridge, and in particular, a centerfire cartridge containing a projectile, from being introduced into the barrel bore 302 via the breech 414.

In some embodiments, each seat pin 316 may have a thickness of about 0.045 inches to about 0.125 inches. In some embodiments, the seat pin(s) 416 is thick enough to allow a projectile to be fired via the firing mechanism without damaging the structural integrity of the seat pin(s) 416. In some embodiments, the seat pin(s) 416 are thick enough to seat the projectile 402 as close to the end 420 of the ignition device 408 as possible. For example, the seat pin(s) 416 may each have a thickness of about 0.02 inches to about 0.04 inches, such as about 0.03 inches. In some embodiments, the seat pin(s) 416 protrude across about 60% to about 90% of the inside diameter of the barrel bore 302. In a non-limiting example, the seat pin(s) 416 are formed from tungsten carbide, ceramic, high nickel alloy, or a combination of or alloy comprising any of the foregoing. In some embodiments, a portion of at least one seat pin 416 extends far enough into the space defined by the barrel bore 302 to prevent a bullet from being loaded into the barrel bore 302 from the breach end of the muzzleloader 102.

As shown in FIG. 6, an extractor 410 may be positioned on an outer diameter surface of the muzzleloader barrel 102. In some embodiments, a receiver lug 426 is configured to house the extractor 410. The extractor 410 may be encapsulated in the receiver lug 426. The receiver lug 426 may be located over at least one seat pin 416 and the extractor 410 such that the at least one seat pin 416 cannot be removed. The muzzleloader barrel 102 may be attached to the receiver 122 via the receiver lug 426. In some embodiments, the at least one seat pin 416 is located in a portion of the muzzleloader barrel 102 adjacent the rearward end of the muzzleloader barrel 102.

As shown in FIG. 4, the extractor 410 may include a horizontal portion 434 and a longitudinal portion 436, which together form a right angle. The right angle portion of the extractor 410 may be located on an outer end portion of the muzzleloader barrel 102. The upper end of the longitudinal portion 436 may have a recessed groove 438. The recessed groove 438 may extend transversely across the extractor 410. As discussed above, a recessed groove 424 may be positioned on an outer end of the breech 414. In one embodiment, the recessed groove 424 extends around the outer diameter of the breech 414. The recessed groove 424 and recessed groove 438 may be aligned to form a continuous groove around the outer diameter of the breech 414. In some embodiments, when an ignition device 408 is inserted into the breech 414, the outer rim 422 of the ignition device 408 may interlock with recessed groove 424 and recessed groove 438. The depth for each of the recessed groove 424 and the recessed groove 438 may correspond to a thickness of the outer rim 422 of the ignition device 408 such that when the ignition device 408 is inserted into the breech 414, the outer surface of the longitudinal portion 436 and the outer surface of the ignition device 408 are flush with one another or lie on substantially the same vertical plane.

The extractor 410 may be configured to slide in a longitudinal direction of the muzzleloader barrel 102. In some embodiments, the extractor 410 may be configured to move forward and backward under the receiver lug 426 in order to extract the ignition device 408. In one or more embodiments, the extractor 410 includes a notched portion 444 located on a portion of the horizontal portion 434 of the extractor 410. The receiver lug 426 may include a cross bar 442 that extends horizontally across the receiver lug 426. As the extractor 410 moves forward under the receiver lug 426, a vertical portion 446 of the notched portion 444 may contact the cross bar 442, preventing the extractor 410 from being completely removed from the receiver lug 426. In some embodiments, the extractor 410 has a ramp end 440 on the horizontal portion 434 of the extractor 410. In some embodiments, an end portion of the receiver 122 has a ramp shape or flat shape configured to press against the ramp end 440 when the muzzleloader 100 is moved to a break open position. As a user moves the muzzleloader 100 into a break open position, the end portion of the receiver 122 may engage with a surface of the ramp end 440 of the horizontal portion 434, thereby driving the extractor 410 rearward toward the rear end of the breech 414. In this aspect, the end portion of the receiver 122 engages the ramp end 440, and slides the extractor 410 from a load position to an eject position. As the extractor 410 moves to the eject position, the recessed groove 438 pushes the inside of the outer rim 422 of the ignition device 408 in an outward manner, thereby sliding the ignition device 408 out of the breech 414. In some embodiments, the extractor 410 may be configured to partially or fully eject the ignition device 408 from the breech 414. In some embodiments, the ramp end 440 of the horizontal portion 434 may have a tapered shape toward the front of the muzzleloader 100.

As shown in FIG. 5B, the ignition device 408 may include one or more visible indicators 502, which may correspond to a weight of a projectile, a velocity the user intends to obtain when firing a projectile, or some other information for the user. The indicator 502 may also correspond to an energy level that the ignition device 408 can produce. For cases in which the ignition device 408 is configured to generate a high energy level, the ignition device 408 may be configured to prevent an over-pressure condition when firing the heaviest commercially available projectile. In one or more embodiments, for cases in which the ignition device 408 is configured to generate a low energy level, the ignition device 408 may be configured to expel the heaviest commercially available projectile from the muzzleloader barrel 102. In one or more embodiments, the indicator 502 may be provided in a variety of manners, locations, and/or combinations, including but not limited to stamping, printing, or marking with a color, color code, number, serial number, product number, letter, word, phrase, code, and combinations thereof. For example, as shown in FIG. 5B, indicators 502 are depicted as XXX and XX XXX, which may be stamped on a rear surface 504 of the ignition device 408. In another example, one or more indicators 502 may be printed as a color or color code on a side surface 506 of the ignition device 408.

The operation of firing the muzzleloader 100 using the ignition device 408 may be as follows. Prior to loading, the breech 414 of the muzzleloader 100 is opened and a visual confirmation is made that a projectile is not resting on the seat pin(s) 416. After visually confirming that a projectile is not in the muzzleloader barrel 102, the breech 414 of the muzzleloader 100 may be closed. In one or more embodiments, by utilizing the embodiments of the muzzleloader 100, the traditional method of using a mark on the ramrod to determine whether a projectile is in the muzzleloader barrel 102 may now be supplemented with a visual review. For example, a user may place a projectile in the muzzle end 102*a* and press the projectile down the muzzleloader barrel 102 via a ramrod until the projectile firmly seats on the seat pin(s) 416. The user may then withdraw the ramrod, open the breech 414 of the muzzleloader 100, and visually confirm that the projectile is seated on the seat pin(s) 416. Based on the indicator of the ignition device 408, the user may then select an ignition device 408 corresponding to the weight of the projectile. Next, the use may place the ignition device 408 within the chamber 448 and close the breech 414. The user may then cock and fire the muzzleloader 100. If the user chooses to unload the muzzleloader 100, the ignition device 408 may be removed at any time, and thus secured separately from the muzzleloader 100. A user may clean the muzzleloader 100 in a conventional fashion.

The muzzleloader 100 disclosed herein provides a significant improvement to muzzleloader technology in several aspects. For example, as the ignition device 408 and chamber 448 prevents a user from using any inappropriate or non-regulated ignition sources (e.g., incorrect black powder and/or black powder substitute; a less expensive and more energetic smokeless powder; or an incorrect volume of black powder or black powder substitute), situations may be avoided that could otherwise cause bodily harm or death to the user. The disclosed muzzleloader also prevents inadvertent double charging—i.e., charging the muzzleloader with an additional powder charge and projectile. Moreover, the muzzleloader 100 can be rendered safe by removing the ignition device 408, which can be easily stored and secured so as to prevent the muzzleloader 100 from being fired by an unauthorized person. Additionally, after firing the muzzleloader 100, a user can prevent unsafe discharge of the muzzleloader 100 by visually confirming if a projectile is present in the muzzleloader 100.

In one or more embodiments, the muzzleloader barrel 102 may be used as a replacement barrel for other commercially available platforms. In one or more embodiments, the breech 414, chamber 448, and ignition device may be utilized in a sound moderated muzzleloader as described in U.S. patent application Ser. No. 16/131,226, which is hereby incorporated by reference in its entirety.

As used herein, the term "about" in reference to a numerical value means plus or minus 10% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A muzzleloader barrel, comprising:

a forward end, a rearward end, and a central bore, the central bore having a central axis, wherein the rearward end comprises a breech that is configured to receive an ignition device; and at least one seat pin that protrudes into a portion of the central bore of the barrel, the at least one seat pin being secured to a wall of the barrel;

wherein a longitudinal axis of the at least one seat pin extends along a tangent to a curve of the central bore.

2. The muzzleloader barrel of claim 1, wherein the at least one seat pin is formed from a material comprising tungsten carbide.

3. The muzzleloader barrel of claim 1, wherein the at least one seat pin is press-fit into the wall of the barrel.

4. The muzzleloader barrel of claim 1, wherein two seat pins protrude into the portion of the central bore of the barrel.

5. The muzzleloader barrel of claim 4, wherein the two seat pins are substantially parallel to each other.

6. A muzzleloader comprising the muzzleloader barrel of claim 1.

7. The muzzleloader of claim 6, wherein the muzzleloader does not include a breech plug.

8. The muzzleloader of claim 6, wherein the muzzleloader is configured such that fixed ammunition cannot be loaded into the breech.

9. The muzzleloader of claim 6, further comprising an ignition device.

10. The muzzleloader of claim 9, wherein the ignition device comprises a propellant powder and a primer.

11. The muzzleloader of claim 10, wherein the propellant powder is black powder or black powder substitute.

12. The muzzleloader of claim 9, wherein the ignition device has a length of about 0.5 to about 3 inches.

13. The muzzleloader of claim 9, wherein an end portion of the ignition device is distorted and configured to open when a propellant powder within the ignition device is ignited.

14. The muzzleloader of claim 9, wherein the ignition device is configured to be destroyed upon firing.

15. The muzzleloader of claim 9, wherein the ignition device includes a visible indicator that corresponds to at least one of a generated energy level of the ignition device, a weight of a projectile, and an obtained velocity when firing the projectile.

16. The muzzleloader of claim 9, further comprising an extractor configured to eject the ignition device from the breech after firing.

17. The muzzleloader barrel of claim 1, wherein the breech comprises a chamber sized such that when an ignition device is installed in the chamber, the ignition device cannot contain a bullet.

18. The muzzleloader barrel of claim 17, wherein the bullet is selected from a saboted bullet, a lead-jacketed or copper-jacketed bullet having any of a spire point, round nose, hollow point, and flat nose, and a monolithic bullet having any of a spire point, round nose, hollow point, and flat nose.

19. The muzzleloader barrel of claim 1, wherein the at least one seat pin has two opposing ends, wherein at least one seat pin end is embedded within the wall of the barrel.

20. The muzzleloader barrel of claim 1, wherein the at least one seat pin has a thickness of about 0.02 inches to about 0.125 inches.

21. A muzzleloader barrel, comprising:

a forward end, a rearward end, and a central bore, the central bore having a central axis, wherein the rearward end comprises a breech that is configured to receive an ignition device; and at least one seat pin that protrudes into a portion of the central bore of the barrel, the at least one seat pin being secured to a wall of the barrel;

wherein the at least one seat pin has two opposing ends, and at least one seat pin end is positioned between and spaced apart from the central bore and an outer surface of the barrel.

22. A muzzleloader comprising the muzzleloader barrel of claim 21.

* * * * *